United States Patent [19]

Hausermann et al.

[11] 4,186,527

[45] Feb. 5, 1980

[54] APPARATUS FOR SHAPING ELECTRODES

[75] Inventors: Marten C. Hausermann, Addison; Elmer P. Hausermann, Bensenville, both of Ill.

[73] Assignee: Hausermann Abrading Process Company, Addison, Ill.

[21] Appl. No.: 931,609

[22] Filed: Aug. 7, 1978

[51] Int. Cl.[2] ..... B24B 19/00

[52] U.S. Cl. ..... 51/58; 51/157; 51/165.77; 219/69 V

[58] Field of Search ..... 51/58, 157, 165.77; 219/69 M, 69 V, 69 G

[56] References Cited

U.S. PATENT DOCUMENTS

| | | | |
|---|---|---|---|
| RE. 27,588 | 2/1973 | Hausermann | 351/157 |
| 3,510,620 | 5/1970 | Smith | 219/69 G |
| 3,597,888 | 8/1971 | Kasakabe | 51/165.77 |
| 3,663,785 | 5/1972 | Hausermann | 219/69 VX |
| 3,672,100 | 6/1972 | Pesaute | 51/165.71 |
| 4,117,634 | 10/1978 | Sagita | 51/165.77 |

*Primary Examiner*—Harold D. Whitehead
*Attorney, Agent, or Firm*—Robert F. Van Epps

[57] ABSTRACT

Improved apparatus for shaping electrodes wherein an abrasive die member is driven into contact with an electrode workpiece member while the die and workpiece members are oscillated with respect to one another in the horizontal plane and wherein the relative vertical motion of the die and workpiece members is controlled as a function of the relative vertical position thereof.

4 Claims, 4 Drawing Figures

APPARATUS FOR SHAPING ELECTRODES

BACKGROUND OF THE INVENTION

1. Field of the Invention

The present invention relates generally to the field of electrical discharge machining more particularly to apparatus for abrasively forming electrical discharge machining electrodes.

2. Description of the Prior Art

Prior to the present invention a method and apparatus for forming electrical discharge machining electrodes were disclosed in U.S. Pat. Nos. 3,663,785 entitled Method of Erosively Shaping a Master Die and Re. 27,588 entitled Apparatus for Shaping Electrodes, respectively. The method and the apparatus for its implementation involved the use of an abrasive die and an electrode workpiece mounted in working alignment with one another. The die and workpiece are moved relative to one another in a horizontal oscillatory rotary motion as they are brought together in the vertical direction such that the workpiece is abrasively formed into the same shape and contour as the die member.

The relative vertical motion of the die and workpiece in the prior art method and apparatus was cyclic to permit removal of abraded particles by flushing with a solvent. The infeed and outfeed portions of the cycle were originally timer controlled at a constant speed with each infeed portion being slightly longer in time than the outfeed portion. A pressure sensor attached to the vertical drive mechanism was used to reverse the drive a a preselected pressure level. The problem encountered with the prior art method and apparatus was that as the abrading process progressed and the contact surface area of the die and workpiece increased the pressure at the interface would vary. During the initial stages of the process when the interface area is small a given pressure would be appropriate, however, as the work progressed and the interface area increased that same pressure level would be too low for efficient abrading. Operation at a constant infeed/outfeed rate thus resulted in damage to both abrading dies and electrodes. If the rate were reduced to thereby relieve the interface pressure the outfeed portion of the cycle was too slow to maintain efficiency.

One partial solution to the pressure problem was to use a first relatively high rate on the first portion of the infeed, a second relatively lower rate during the portion of the infeed while abrasion was being accomplished and to return to the relatively higher rate for the outfeed portion of the cycle. Switching between the two rates was performed as a function of time. While beneficial to some degree this approach still failed to solve the pressure problem since as the die-workpiece interface area increased the operation of hydraulic valves would become inconsistent, the infeed distance would increase and the outdistance would decrease. It was therefore necessary for a skilled operator to constantly monitor the cycle timer and to make continuous adjustments preferably in anticipation of excessive pressure build-up.

OBJECTS AND SUMMARY OF THE INVENTION

From the preceding discussion, it will be understood that among the various objectives of the present invention are included the following:

the provision of a new and novel apparatus for abrasively forming electrical discharge machining electrodes;

the provision of apparatus of the above-described character wherein the relative vertical motion of the abrading die and workpiece member is controlled as a function of their position with respect to one another;

the provision of apparatus of the above-described character in which excessive pressure at the abrading die-workpiece interface is automatically prevented; and the provision of apparatus of the above-described character which requires a minimum of monitoring by an operator.

These as well as other objectives of the present invention are achieved by applying relative horizontal oscillatory rotary motion to the die and workpiece, sensing the vertical position of the abrading die with respect to the electrode workpiece member, infeeding at a first relatively higher rate until the die and workpiece reach a predetermined relative vertical position, continuing infeeding at a second relatively lower rate for a predetermined distance, outfeeding at the relatively higher rate for a distance slightly less than the total infeeding distance, applying a solvent between the die and workpiece to flush particles away and repeating the cycle until an electrode of the same shape and contour as the die member has been formed. Means for continuously monitoring the relative vertical position of the die and workpiece is provided as is a source of reference for at least three predetermined relative positions. The actual relative position is compared with the predetermined relative positions in a comparator, the outputs of which operate to control a variable rate vertical drive means.

The foregoing as well as other objects features and advantages of the present invention will become more apparent from the following detailed description taken in conjunction with the various views of the appended drawings.

DESCRIPTION OF PREFERRED EMBODIMENT

Figure 1:
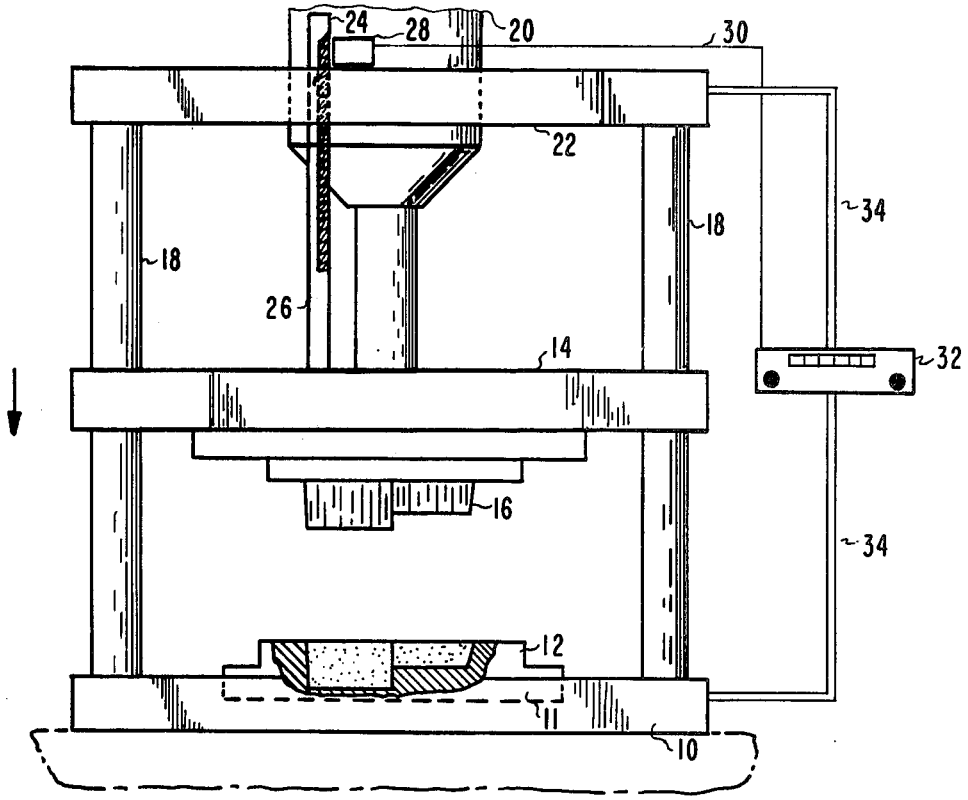
FIG. 1 is a simplified elevation view illustrating an electrode abrading machine improved in accordance with the principles of the present invention.

Turning now to FIG. 1 there is shown a simplified elevation view of an electrode abrading machine improved in accordance with the present invention. For a detailed description of the basic abrading apparatus, reference may be had to U.S. Pat. No. Re. 27,588 and the method of abrading electrodes is set forth in U.S. Pat. No. 3,663,785. The improvement of the present invention resides in the apparatus for controlling the operation of the basic apparatus which will only be discussed herein insofar as is necessary to describe the improvement.

The basic electrode abrading apparatus includes a base member 10 and a first platen 11 upon which is mounted an electrode workpiece member 12. A second platen 14, to which there is mounted an abrading die 16, is disposed in superimposed relation to the first platen 11 and the former is adapted to be driven along the vertical support members 18 by a drive means 20 which is typically a hydraulic ram mounted to the superstructure 22 of the apparatus. The drive means 20 is, of course, reversible and in the context of the present invention may be operated at at least two drive rates. The manner in which the drive rates are achieved will be well known to those skilled in the hydraulics arts and generally would be by means of solenoid actuated hydraulic valves of varying capacity and orientation. The first platen 14 is further adapted to be driven in oscillatory rotary motion in the horizontal plane as described in the above-referenced patents.

To the basic apparatus there is added a vertical position sensor shown generally at 24. A variety of such sensors are commercially available including electromechanical, magnetic and optical devices. In the preferred embodiment, a rack and pinion direct drive position encoder which is manufactured by Elm Systems of Wauconda, Illinois, has been found by the applicant to be suitable. The rack 26 is fixed to the second platen 14 and extends upwardly through the superstructure 22. The pinion and direct drive encoder 28 are fixed to the superstructure 22. As the second platen 14 is driven along the vertical supporting members 18 a signal representing the distance traveled by the second platen 14 (and thus the abrading die 16) is transmitted via cable 30 to the control unit 32 which will be more fully described hereinbelow. The control unit 32 may be disposed anywhere convenient to the surroundings, and brackets 34 for mounting to the abrading apparatus are shown for illustrative purposes only.

Figure 2A:
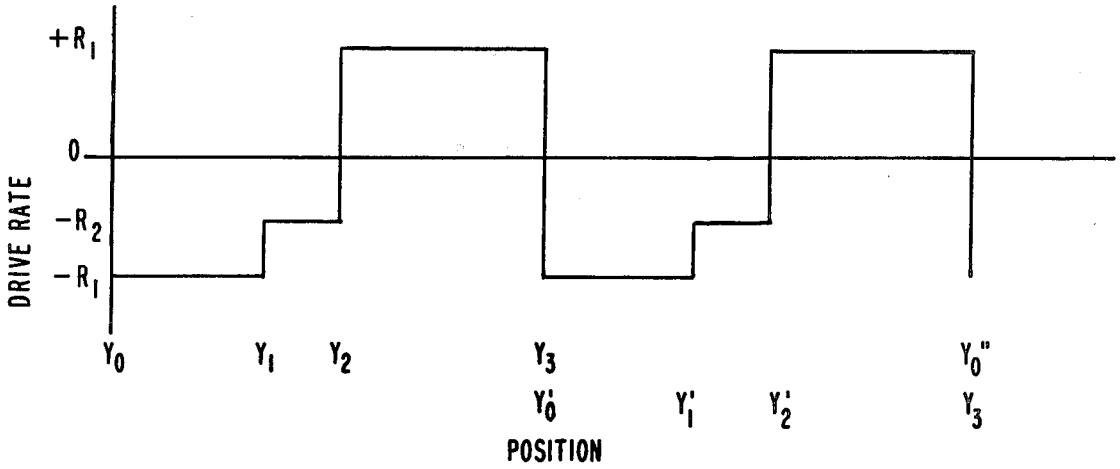
FIGS. 2A and 2B are graphs representing the character of the preferred relative motion of the abrading die and workpiece shown in FIG. 1.
Figure 2B:
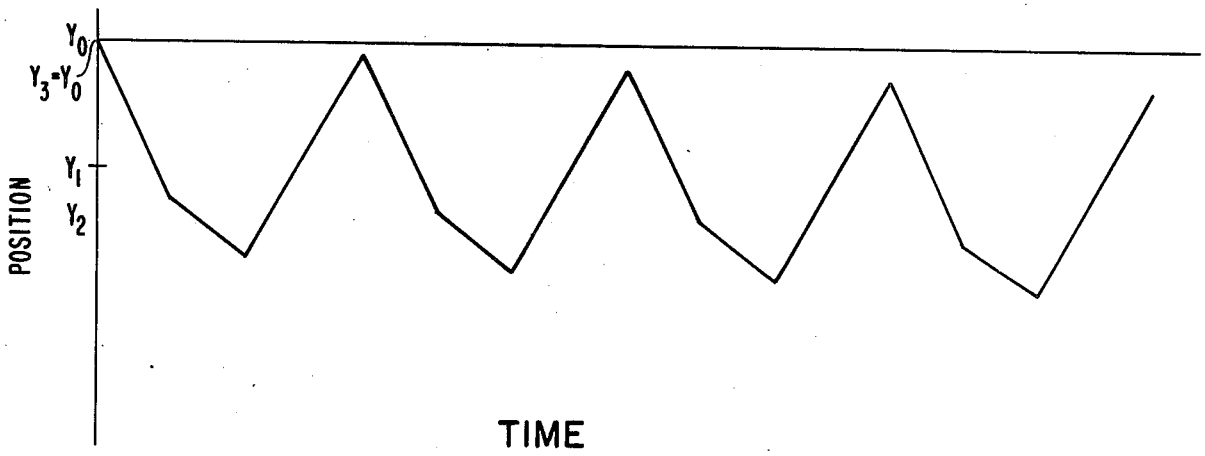

FIG. 2A is a graph illustrating the preferred vertical operation of the apparatus of FIG. 1, in terms of drive rate as a function of position, and FIG. 2B illustrates position as a function of time. The cycle starts from any desired initial position $y_o$, with a downward or negative infeed at a first, relatively high rate, $-R_1$. Upon the abrading die reaching a first predetermined position, $y_1$, with respect to the workpiece; i.e. as contact between the die and workpiece is made, the infeed rate is reduced to $-R_2$. The infeed continues at the lower rate until a second predetermined relative position, $y_2$, is reached, thus indicating that the desired amount of workpiece material has been removed by abrasion. The die is then withdrawn at the relatively higher rate, $+R_1$, to a third predetermined position, $y_3$. The outfeed portion of each cycle is always to a position slightly lower than the starting position for the next preceeding cycle; i.e. the outfeed is less than the total infeed for each cycle. During the outfeed portion of the cycle the workpiece is flushed with a solvent as was done in the prior art to remove accumulated particles. The cycle is then repeated until abrasion of the electrode has been completed. This cyclic operation may further be automatically terminated when the die reaches a fourth predetermined position corresponding to the maximum desired abrading depth.

Figure 3:
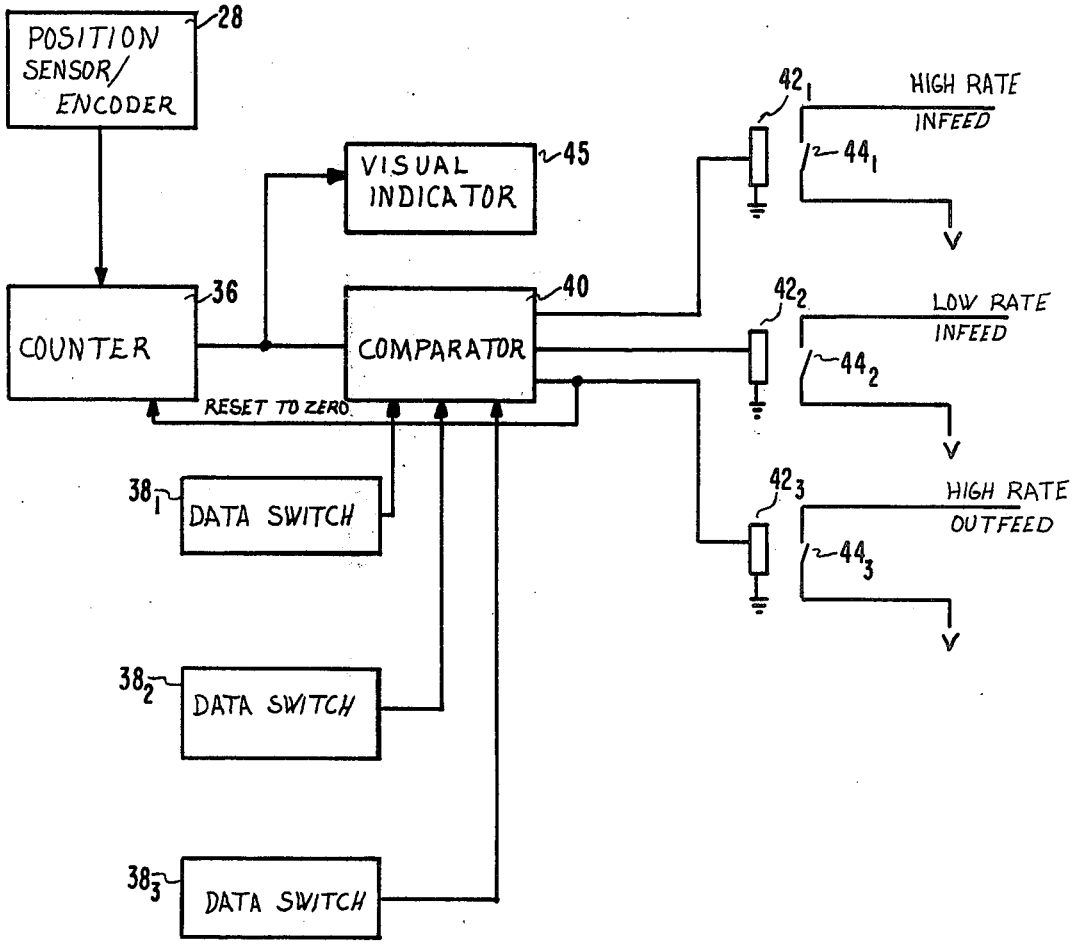
FIG. 3 is a schematic block diagram of the control unit for producing the relative motion represented by FIG. 2.

With reference now to FIG. 3 there is shown in schematic block diagram form an electrode abrading machine control system in accordance with the present invention. The position sensor/encoder 28 operates to generate a pulsed square wave output signal with each pulse representing one increment of vertical travel. The position sensor signal is coupled to a pulse counter 36 the output signal from which represents the distance the abrading die has traveled from its initial position, $y_o$. A plurality of data switches $38_{1\text{-}3}$ are provided through which an operator may enter the plurality of dimensions through which the second platen is to travel in order to define the desired vertical cyclic motion. Each of the data switches 38 is coupled to a comparator 40 which operates to produce an output signal at various of its output terminals in accordance with the position of the abrading die relative to the predetermined travel entered via the respective data switches 38. The comparator outputs are coupled to corresponding relay coils $42_{1\text{-}3}$. The normally open relay contacts $44_{1\text{-}3}$, upon closure apply an operating voltage, V, to the hydraulic valve solenoids (not shown) either individually or in combination, to effect the high rate infeed, low rate infeed and high rate outfeed of the hydraulic ram. A visual indicator 45 may be coupled to the counter 36 output to facilitate monitoring the operation.

By way of illustrative example, assume that the operator were to enter the following dimensions into the respective data switches:

data switch $38_1$: 0.070 inch
data switch $38_2$: 0.033 inch
data switch $38_3$: 0.100 inch With these dimensions entered, contacts $44_1$ close and the second platen would infeed 0.070 inch at the relatively high rate. At that point the output of counter 36 and data switch $38_1$ become equal and the appropriate output of comparator 40 activates relay coil $42_2$ closing contacts $44_2$ and relay $42_1$ is released opening contacts $44_1$. The infeed then continues at the relatively lower rate for an additional 0.033 inch at which point the output of counter 36 and data switch $38_2$ become equal. The comparator output energizes relay coil $42_3$ closing contacts $44_3$ and releases relay coil $42_2$ opening contacts $44_2$. The second platen then outfeeds at the relatively higher rate for 0.100 inch when the outputs of counter 36 and data switch $38_3$ become equal. The cycle is then repeated with each total infeed distance being slighly greater than the outfeed distance such that successively deeper abrasion of the workpiece is accomplished.

Particularly in situations where the total abrasion depth is relatively large, it has been found by the applicant that it is desirable to reset the counter 36 to zero at the end of each cycle; i.e. the position, $y_3$ for each cycle is reset as $y_o'$ for the next cycle. In this manner any error in the position sensor/encoder 28 output or that of the counter 36 itself is prevented from becoming cumulative. It will further be apparent that additional features may easily be provided by the addition of further data switches and comparator capacity. For example, the maximum abrasion depth and the distance of some maximum outfeed required to permit removal of the finished electrodes could be entered via two further data switches. Thus when the maximum depth is reached, the second platen would automatically outfeed at the relatively higher rate to the maximum outfeed position and stop.

From the foregoing discussion it will be understood that the applicant has provided a new and improved method and apparatus for shaping electrodes whereby the objectives set forth hereinabove are efficiently achieved. Since certain changes in the above-described method and construction will occur to those skilled in the art without departure from the scope of the invention, it is intended that all matter set forth in the preceding description or shown in the appended drawings shall be interpreted as illustrative and not in a limiting sense.

Having described what is new and novel and desired to secure by Letters Patent, we claim :

1. An improved apparatus for forming electrical discharge machining electrodes said apparatus being of the type including a first platen, a second platen mounted in superimposed relation and adapted to be driven vertically with respect to said first platen, a die member having an abrasive surface mounted on one of said platens, a workpiece member mounted on the platen opposite the platen on which said die member is mounted in working alignment with said die member, means for applying horizontal oscillatory rotary motion to said first platen, vertical drive means for infeeding said workpiece member and said die member into contact with each other while said oscillatory rotary motion is being applied to thereby abrasively shape said workpiece member to the form of said die member, and wherein said improvement comprises means for sensing the relative vertical position of said die member with respect to said workpiece member and generating an output signal representing said relative vertical position;

means for providing a first predetermined reference signal representing a first relative vertical position and corresponding to a preselected maximum vertical distance between said die member and said workpiece member;

means for providing a second predetermined reference signal representing a second relative vertical position and corresponding to a vertical distance between said die member and said workpiece member of substantially zero;

means for providing a third predetermined reference signal representing a third relative vertical position and corresponding to a preselected penetration of said workpiece member by said die member;

means coupled to said sensing means, and to said first, second and third reference signal means for comparing the output signal of said sensing means with said first, second and third reference signals and for generating first, second and third output signals when the output of said sensing means is equal to said first, second and third reference signals respectively;

said vertical drive means being adapted for infeed and outfeed operation at at least two drive rates; and means coupled to said comparing means for cyclically controlling the operation of said vertical drive means to infeed said die member and said workpiece member at a first relatively higher rate until the output signal of said sensing means is equal to said second reference signal, at a second relatively slower rate until the output signal of said sensing means is equal to said third reference signal, and to outfeed said die member and said workpiece at said first relatively higher rate until the output signal of said sensing means is equal to said first reference signal.

2. Apparatus as defined in claim 1 wherein said sensing means comprises a direct drive position encoder coupled to said second platen and adapted to generate a pulsed output signal as said second platen is driven with each said output pulse representing one preselected increment of travel, and a pulse counter coupled to said encoder and adapted to generate an output signal representing the position of said die member with respect to said workpiece member.

3. Apparatus as defined in claim 2 and further including means coupled to the output of said comparing means and to said pulse counter for resetting said counter to zero when the output signal of said sensing means is equal to said first reference signal whereby in each successive cycle of said drive means operation the preselected penetration of said workpiece member by said die member is progressively deeper.

4. Apparatus as defined in claim 1 and further including a visual indicator coupled to said sensing means for displaying the position of said die member with respect to said workpiece member.

* * * * *